United States Patent [19]

Jailor et al.

[11] 4,418,261

[45] Nov. 29, 1983

[54] MICROWAVE OVEN AND VENTILATOR SYSTEM

[75] Inventors: John J. Jailor, Marengo; Ronald A. Thalacker, Amana, both of Iowa

[73] Assignee: Amana Refrigeration, Inc., Amana, Iowa

[21] Appl. No.: 339,787

[22] Filed: Jan. 15, 1982

[51] Int. Cl.[3] ..... H05B 6/64; F24C 15/30

[52] U.S. Cl. ..... 219/10.55 R; 219/400; 126/299 D; 126/21 A; 98/115 VM; 312/236

[58] Field of Search ..... 219/10.55 R, 10.55 B, 219/10.55 A, 400; 126/21 R, 21 A, 299 R, 299 D, 299 E, 1 AD, 1 D, 273 R; 98/115 R, 115 VM; 312/236

[56] References Cited

U.S. PATENT DOCUMENTS

| | | | |
|---|---|---|---|
| Re. 22,228 | 12/1942 | Petersen | 126/299 |
| 3,089,479 | 5/1963 | Perl | 126/21 R |
| 3,131,688 | 5/1964 | Lipstein | 126/299 |
| 3,251,290 | 5/1966 | Jenson et al. | 98/115 |
| 3,785,124 | 1/1974 | Gaylord | 98/115 X |
| 3,818,171 | 6/1974 | Miller et al. | 219/10.55 R |
| 4,108,139 | 8/1978 | Gilliom et al. | 126/21 A |
| 4,143,646 | 3/1979 | Sampsel | 126/299 D |
| 4,180,049 | 12/1979 | Carr et al. | 126/21 A |
| 4,233,194 | 9/1980 | Fitzmayer | 219/10.55 R X |
| 4,254,450 | 3/1981 | White et al. | 219/10.55 R X |
| 4,284,868 | 8/1981 | Simpson | 219/10.55 R X |
| 4,327,274 | 4/1982 | White et al. | 219/10.55 R |
| 4,332,992 | 6/1982 | Larsen et al. | 219/10.55 B X |
| 4,332,993 | 6/1982 | Shibahara et al. | 219/10.55 R |
| 4,354,084 | 10/1982 | Husslein et al. | 219/10.55 R |

*Primary Examiner*—B. A. Reynolds
*Assistant Examiner*—Philip H. Leung
*Attorney, Agent, or Firm*—William R. Clark; Joseph D. Pannone

[57] ABSTRACT

A system of combining a microwave oven and ventilator over a range top or the like wherein the ventilator comprises an assembly including a central oven receiving compartment and air handling components providing for an exhausting of the range top atmosphere and a maintenance of the oven in a relatively contamination free environment. The ventilator includes a downwardly directed filter-mounting cavity underlying the oven. A pair of vertically extending air directing channels are provided to each side of the oven receiving compartment and extend vertically from communication with the underlying cavity to a pair of chambers located above the oven compartment and in direct communication with an exhaust blower positioned centrally therebetween. The exhaust blower is communicated with the ambient atmosphere above the oven compartment for introduction of cooling uncontaminated air. The microwave oven itself incorporates a separate air flow system wherein air is drawn in from the front face of the assembly at a point remote from the point of introduction of the range air into the ventilator.

4 Claims, 10 Drawing Figures

MICROWAVE OVEN AND VENTILATOR SYSTEM

BACKGROUND OF THE INVENTION

This invention relates generally to a combination microwave oven and exhaust vent or ventilator appliance, and more particularly to an air flow system for the combination.

Combination microwave oven and conventional range systems are well known in the art. Many manufacturers of major appliances market such systems. One popular system is comprised of a unitary structure having a traditional electric range mounted in a lower portion and a microwave oven mounted in an upper portion. Another popular combination is that of a traditional gas or electric range adapted to accommodate a microwave generating system in the same oven cavity. More recently, a number of major appliance manufacturers have marketed a microwave oven adaptable for installation above and separate from a traditional range. These microwave ovens utilize the space formerly allocated to the range hood ventilation system, and have been modified or adapted to accommodate the functions formerly provided by the exhaust vents.

Because these combination microwave oven and exhaust vents or ventilators are designed to accomplish the purposes originally accomplished by two appliances, compromises have been made. Significant compromises have also been required in light of the limited space generally available above a range, cooktop or grille, such cooking surfaces normally being approximately 30" wide. For example, most ceilings are only 8' high with the kitchen in many homes designed to place cabinets above the lower cooking surface. Traditional vent hoods or ventilators have been designed to adapt to or coordinate with these kitchen cabinets, placing the hood far enough away from the cooking surface to allow easy access to the heating elements and the controls, yet close enough to remove the hot, frequently greasy, air rising from the lower cooking surface.

As a result of these space limitations in particular, the prior art attempts to provide for an overhead mounting of a microwave oven, or the combination of a microwave oven with a ventilator, have heretofore required compromises in the microwave oven, the ventilating system, or both. Some such compromises have resulted in smaller-than-usual microwave oven cooking cavities to allocate greater space to the ventilator portion of the system. One example will be noted in U.S. Pat. No. 4,254,450 to White et al, issued Mar. 3, 1981. Other systems have attempted to retain most of the advantages and size of a typical countertop microwave oven by reducing the air handling capability of the ventilating portion of the combination appliances.

A major design consideration for such combination appliances, particularly in view of the space limitations, is the maintenance of the separate air circulation systems that microwave ovens and ventilation hoods normally require or exhibit. Specifically, the microwave oven portion of such a system requires a quantity of air to cool the high voltage compartment. It also requires, in the case of an air driven microwave stirrer or antenna distribution system, a source of air movement to rotate the energy distribution system. Lastly, it has generally been found to be preferable in the operation of a microwave oven to circulate air past the door to remove any steam condensed thereon. This improves the visibility in the oven cavity. All of the above-mentioned requirements for air are for relatively dry, cool and clean air.

Cool, uncontaminated air is generally not what rises from the surface of a conventional range, cooktop or grille when in operation. The process of cooking, by its very nature, vaporizes quantities of water and grease, creating much of the air which a ventilation hood removes due to the heat expansion of the air. Water, for example, expands approximately 1800 times when it becomes steam. It is primarily this hot, grease-laden air that rises from the cooking surface and is exhausted by a ventilator. Hence, the operation of the ventilator portion of a combination system in removing the hot, grease-laden air rising from the cooking surface is not necessarily compatible with the microwave oven portion. The problems are compounded by the fact that the exhaust vent itself requires a certain amount of cool, dry and clean air to ensure its long life and serviceability.

SUMMARY OF THE INVENTION

The instant invention, then, is to an overall air flow system for a microwave oven and exhaust vent combination appliance for installation above a traditional range, cooktop or grille taking into consideration the air needs of the microwave oven, the air needs of the ventilator and the need to remove hot, moist and sometimes grease-laden air generated by cooking on the lower cooking surface. The air flow system is a substantial improvement over the prior art in that it accommodates the appliance's need for air, in both the microwave oven and the ventilator, while removing the undesirable and volatile by-products generated by a cooking surface therebeneath. Further, it accomplishes its goals in the space available and in a manner which allows easy cleanability and serviceability of all components and assemblies.

According to the invention, there is provided an air flow system for a combination microwave oven and ventilator appliance for installation above a conventional range, cooktop or grill which exhausts hot, grease-laden air much the same as a traditional ventilator while simultaneously providing an ambient environment substantially free of contaminates from which air can be drawn into the microwave oven.

The primary object of the invention is to provide, in a combination appliance, an air flow system which enables the functioning of the microwave oven and ventilator portions to the same capability sought in independent installations, providing both with the quality and quantity of air most desired for maximum performance.

Another object of the invention is to provide an air circulation system for such a combination appliance that maximizes the amount of air that may be exhausted from a range, cooktop or grille surface.

Another object of the invention is to minimize the movement of hot air rising from the surface of the lower cooking surface past the front of the microwave oven portion of the dual appliance.

A further object is to provide an air flow system for a combination microwave oven and exhaust vent that is readily cleaned and serviced.

Another object is to provide an air flow system for such a combination appliance that effectively increases the efficiency and useful life of the components of the appliance.

A further object is to provide the microwave oven portion of the combination appliance with a working or operating environment similar to that normally associated with a living area, that is, free of contaminated air from the underlying cooking surface, notwithstanding the close relationship thereto.

Another object is to provide a combination microwave oven and exhaust vent appliance wherein the exhaust vent portion of the appliance is adaptable to vertical or horizontal air exhaustion to accommodate alternative installations without loss of air exhaust capacity.

The objects of the invention are basically achieved by the provision of an overhead ventilator or ventilator assembly which incorporates a central support shelf or oven receiving compartment in conjunction with means for receiving contaminated air from an underlying range top, cooking surface, or the like for movement of the air to a point of discharge without affecting the operating environment of the oven itself. The ventilator assembly includes an enlarged air receiving cavity underlying the microwave oven which, through appropriately mounted filters, directly receives the air rising from the range. This air is channeled vertically to each side of the oven into a pair of laterally spaced overlying chambers which in turn communicate with a central blower chamber within which an exhaust blower is mounted for an inward drawing of the air followed by an exhausting thereof through appropriate duct work to a remote point. The contaminated air moves along paths which ensure a proper discharge of the contaminated air while providing an ambient atmosphere of clean dry air for operation of the microwave oven to the optimum, notwithstanding the combining of the microwave oven and ventilator into a single appliance and the positioning of the microwave oven in a position directly over a range top or the like.

Other objects and advantages of this invention will become apparent from the following description, the accompanying drawings and appended claims.

DESCRIPTION OF THE PREFERRED EMBODIMENT

Figure 1:
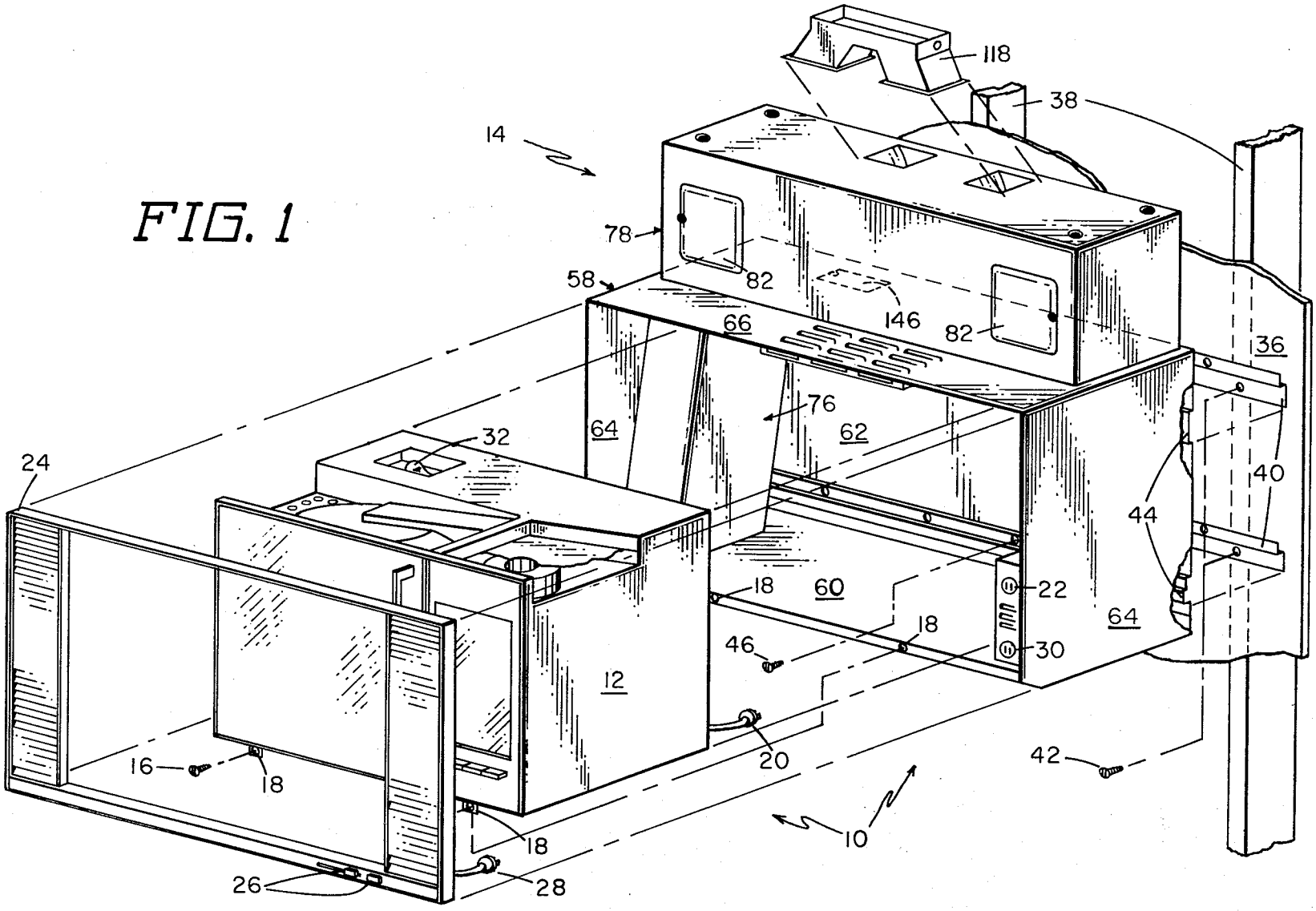
FIG. 1 is an illustrative, exploded perspective view of the combination microwave oven and ventilator appliance of the present invention.

Referring now more particularly to the drawings, wherein like numerals refer to like parts, FIG. 1 illustrates, in an exploded perspective, a combination microwave oven and ventilator appliance 10. Appliance 10 is broadly made up of a microwave oven 12 and a combination exhaust vent and microwave oven support shelf assembly 14. When installed, microwave oven 12 is slid into position in a central compartment assembly 14 and secured by suitable screws 16 through holes 18. Microwave oven 12 is supplied with current through an electrical plug 20 engaged in outlet 22 which is, in turn, connected to an external source of, for example, 120 volt, 20 ampere, alternating current. Microwave oven 12 may use any microwave circuitry and related components as well known in the art.

Installation of microwave oven 12 into assembly 14 is completed by attachment of a louvered facing panel 24. Panel 24 may contain controls 26 for operation of the range hood assembly 14. In such case, controls 26 may be suitably electrically connected for operating of the hood exhaust, in any manner well known in the art, through engagement of electrical plug 28 to outlet or socket 30. Panel 24 may be connected to assembly 14 in any number of ways well known in the art.

Microwave oven 12 is equipped with a light bulb 32 for illumination of the cooking cavity of microwave oven 12. Access to the bulb 32 may be reached through disassembly of microwave oven 12 and assembly 14 opposite to the manner in which they are assembled or through an appropriate access panel in the ventilator assembly.

Figure 5:
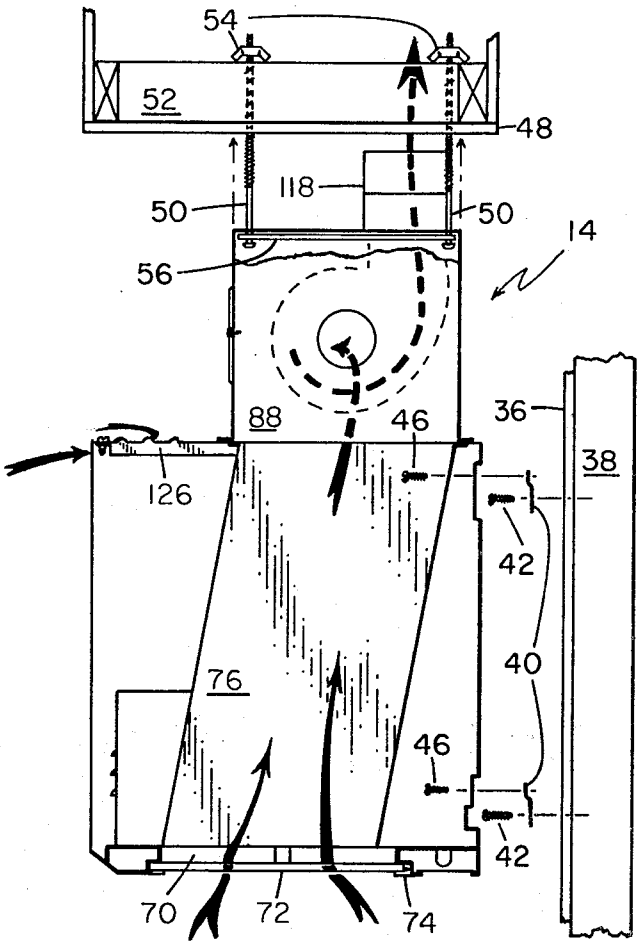
FIG. 5 is a side view of the appliance shown in FIG. 4 with portions removed and broken away to show more of the air flow.

Prior to the assembling of appliance 10, assembly 14 may be suitably attached to wall 36 in any appropriate manner. In FIGS. 1 and 5, assembly 14 is attached directly to wall studs 38 by channels 40. Channels 40 are first positioned on wall 36 by screws 42 engaged therethrough and into studs 38. Next, channel-mating hangers or hanger portions 44 on assembly 14 are positioned on channels 40 and removably attached to channels 40 by screws 46 for support of the assembly.

Figure 4:
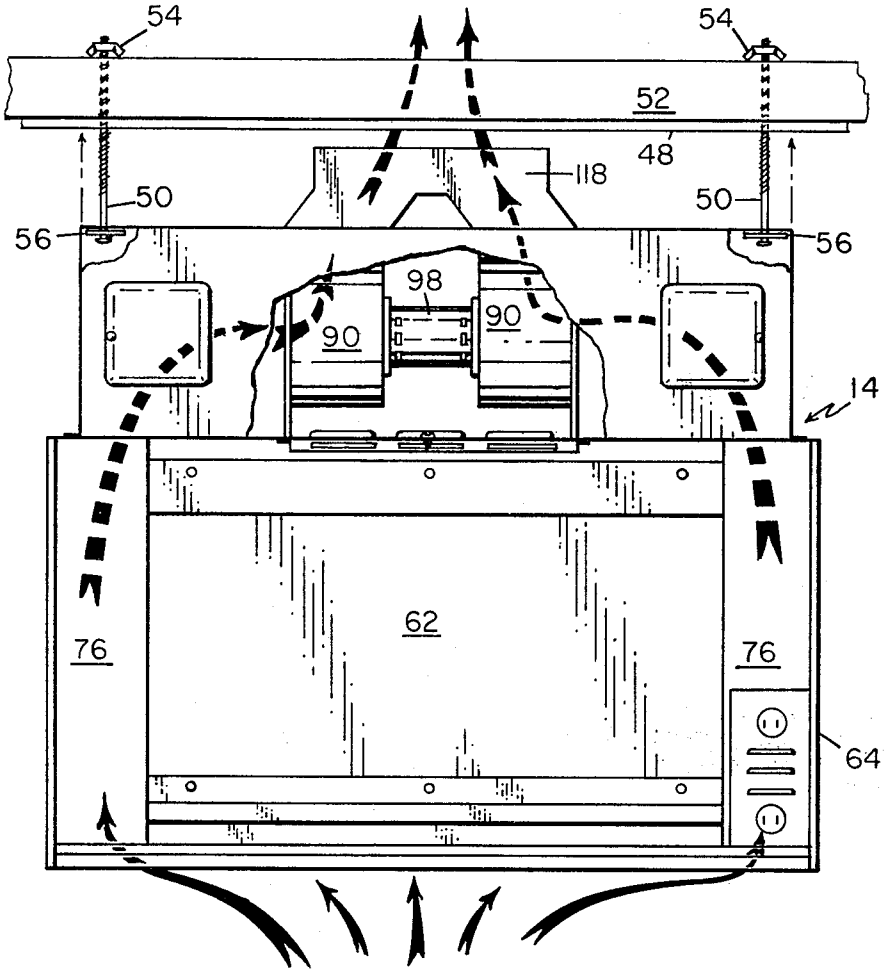
FIG. 4 is a front view of the appliance shown in FIG. 3 attached to a soffit.

Also shown in FIG. 5 as well as FIG. 4, is an alternative installation of assembly 14 wherein the assembly 14 is attached to soffit 48. In the soffit mounting arrangement, vertical threaded rod members 50 hold assembly 14 to soffit 48 by engagement through the overhead soffit joints 52 with tee nuts 54 threaded on the upper ends of the rod members. The upper portion of assembly 14 may be suitably strengthened by the use of horizontal support members 56 to withstand the weight of assembly 14 and avoid tearing out the sheet metal in the area of vertical members 50. It is understood that there are many other ways in which appliance 10 may be attached to and supported on wall 36 or soffit 48, and the manner of attachment shown is merely illustrative.

Structural, the assembly 14 includes an enlarged, normally rectangular, housing 58 which is adapted to receive and mount the oven 12 in spaced overlying relation to a range surface or cooking grille (not shown).

The housing 58 includes a bottom panel or shelf 60 which directly receives and supports the oven, a rear panel 62 incorporating the hangers 44, opposed side panels 64, and a top panel 66.

The forward edge of the bottom panel 60 is rigidified by a full length rail 68 which receives the oven mounting screws 16. This rail 68 depends below the bottom panel or shelf 60, as do the lower edges of the rear and side panels 62 and 64, to define a shelf underlying cavity 70. An appropriate rear rail may also be provided.

A pair of conventional grease filters 72 are mounted, utilizing appropriate filter-edge receiving support and/or crossbars 74, in parallel spaced underlying relation to the support shelf 60 in order to define an air flow passage or chamber within the cavity 70 immediately above the filters.

A vertical air passing channel 76 is provided along the inner face of each of the side panels 64 and provides direct communication between the shelf underlying cavity 70, at the corresponding end thereof, and the interior of a secondary housing 78 mounted on the top panel 66. As will be appreciated from FIG. 3 in particular, the channels 76 open respectively through the bottom and top panels 60 and 66. The channels 76 are of a generally rectangular configuration with planar inner faces 80 which define side walls of a central compartment within the housing 58 wherein the oven 12 is positioned. The outer wall of each of the channels 76 will normally be defined by the adjacent housing side panel 64.

As will be appreciated from the drawings, the depth of the secondary housing 78 is substantially less than that of the housing 58 and extends transversely across the top panel 66 offset rearwardly from the front of the housing 58.

Figure 3:
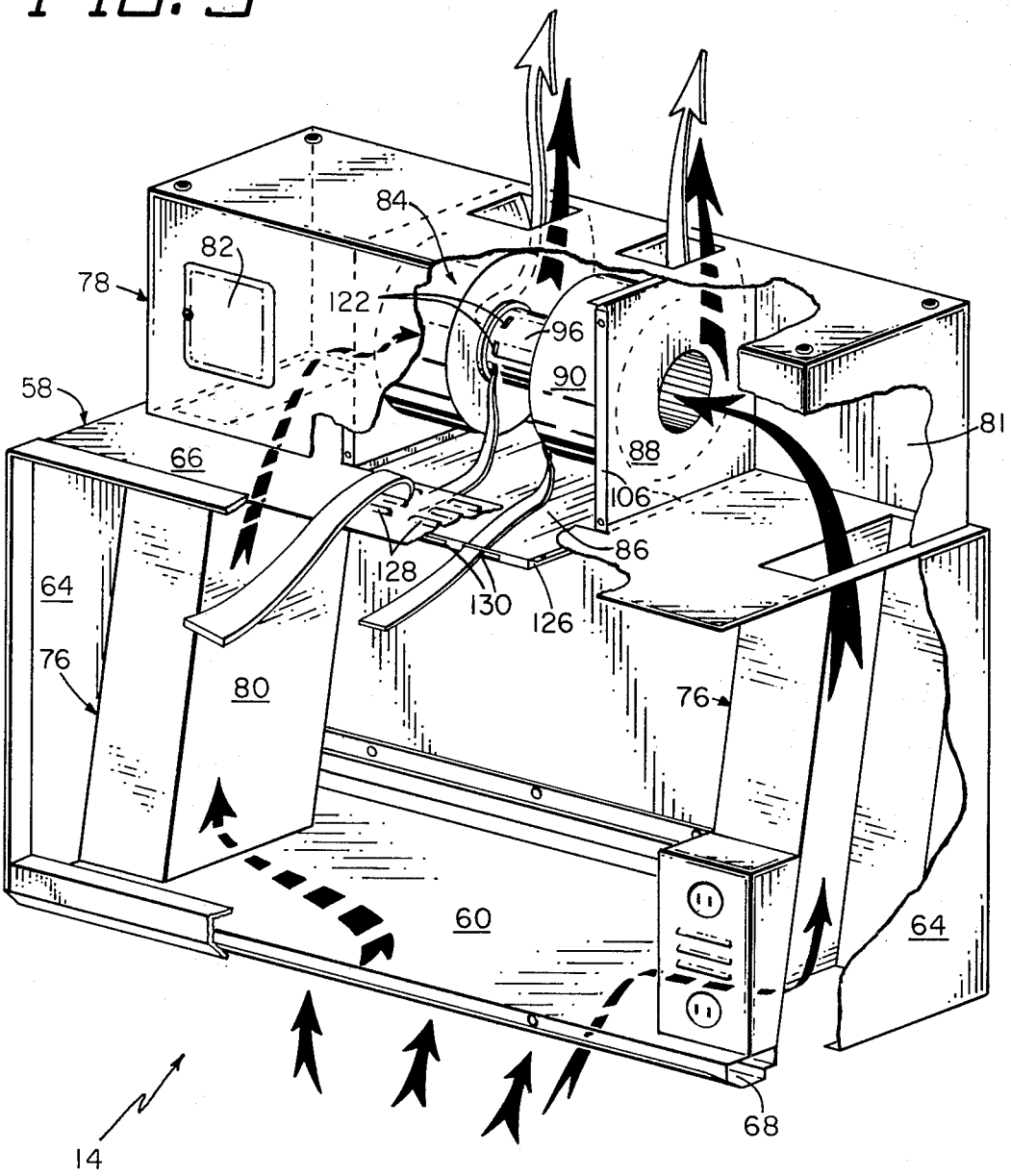
FIG. 3 is a perspective view of the appliance shown in FIG. 2 with the microwave oven removed and portions broken away showing another portion of the air flow.

Noting FIGS. 3 and 5 in particular, it will be appreciated that the side channels 76 incline slightly rearward from the lower cavity communicating end thereof to the upper end thereof in communication with the interior of the secondary housing 78. In this manner, the channels 76 communicate centrally both with the underlying cavity 70 and the rearwardly offset secondary housing 78. Incidentally, in order to ensure a positive movement of air from the underlying cavity 70, and ensure an effective exhausting of hot, grease-laden air rising from an underlying range top, the channels 76 are preferably of a depth substantially equal to that of the shelf underlying cavity into which, through the filters 72, the air is initially drawn.

The secondary housing 78, also preferably of a rectangular configuration, includes a pair of opposed end chambers 81, each provided with an access panel 82 through the front wall of the secondary housing 78. The end chambers 80 have the upper ends of the vertical channels 76 directly communicating therewith. The blower 84 for the assembly 14 is mounted within a central chamber 86 defined between the two end chambers 80 of the secondary housing 78 by a pair of spaced side walls 88. The blower 84 comprises a pair of laterally spaced blower scrolls 90 bolted, as at 92, to the opposite end plates 94 of the outer casing 96 of a motor 98. The blower wheel 100 within each scroll 90 mounts on and is directly driven by the motor shaft 102.

Figure 10:
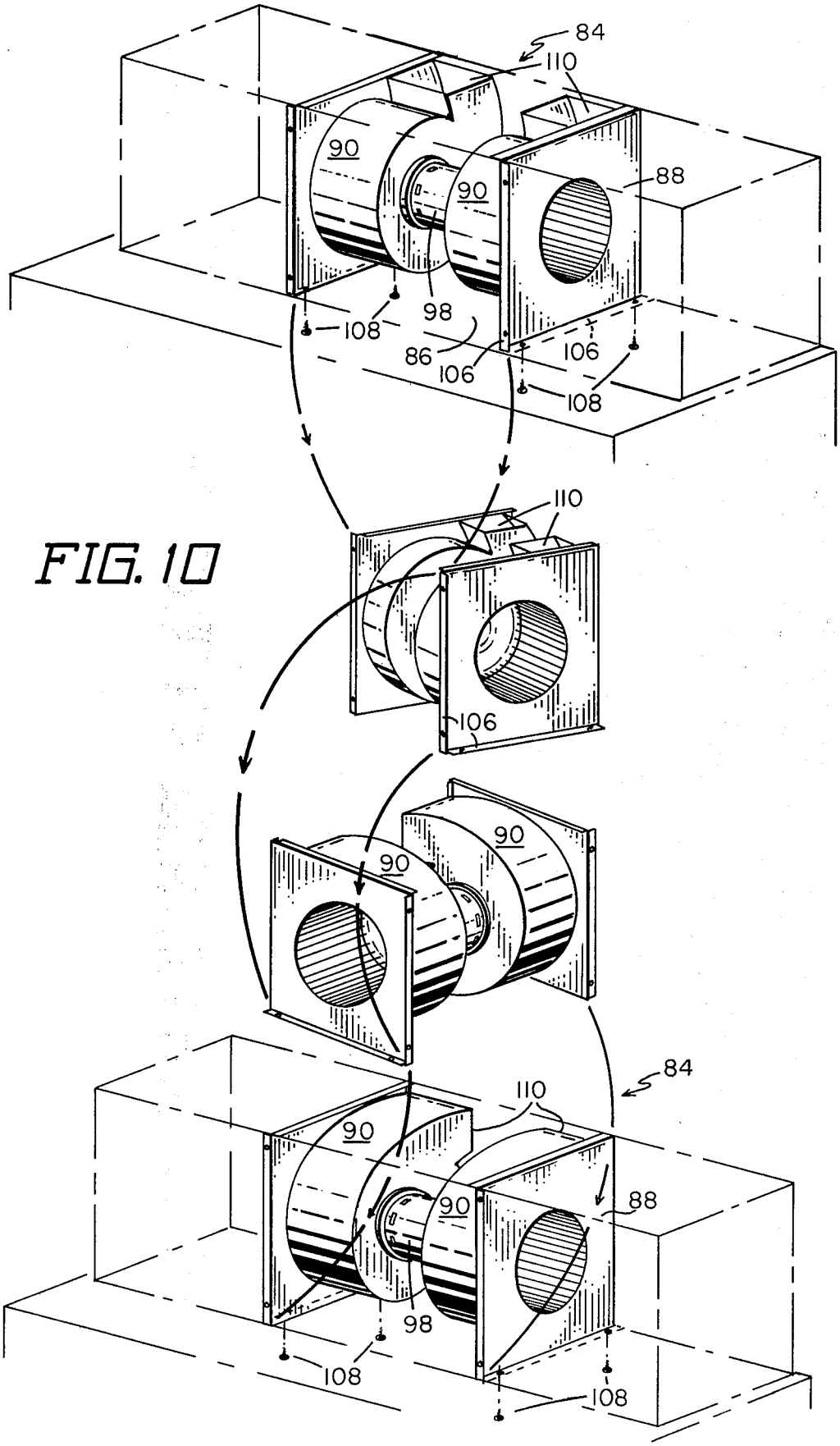
FIG. 10 is a view showing how a portion of the assembly shown in FIG. 3 and FIG. 6 may be rotated to adapt to different installational requirements.

The blower 84 is mounted within the secondary housing 78 by the chamber defining side walls 88. The side walls 88 are directly screwed, bolted, or otherwise affixed to the opposed outer faces of the blower scrolls 90, note, as an example, screws 104. These side walls 88, in turn, incorporate outwardly turned edge flanges 106 along two edges thereof which are screwed or bolted, as at 108, to the top panel 66 of the housing 58, this panel defining the bottom of the secondary housing 78. Noting FIG. 10 in particular, it will be appreciated that the secondary housing 78 is square in cross-section with the wall mounted blower assembly 84 being readily oriented to direct the scroll outlets 110 not only vertically, as indicated in FIGS. 1–7, but also horizontally should a particular installation require such an arrangement. FIG. 10 schematically illustrates the manner in which the blower assembly is rotated 180° about a vertical axis and 90° about a horizontal axis to position the outlets for horizontal discharge.

Access to the blower chamber 86 for servicing, removal, or reorientation of the blower 84, is achieved through an enlarged opening 112 defined through the top panel 66 immediately underlying the blower assembly 84. This opening 112 is of a size to allow passage of the blower assembly 84, including the side walls 88, vertically therethrough. The outwardly turned edge flanges 106 along the side wall edges constituting the bottom edges, this depending on the particular orientation of the blower assembly 84, will engage against the undersurface of the top panel 66 to the opposed sides of the opening. The blower assembly 84 is fixed in position by means of the previously referred to fasteners 108 engaging upward through the bottom edge flanges 106 and into or through appropriate fastener receiving apertures 114 through the aligned edge portions of the top panel 66. As will be best appreciated from FIGS. 8 and 9, in order to accommodate the outwardly turned edge flanges 106 which lie along the vertical edges of the side walls, the assembly accommodating opening 112 will be provided with corner slots 116, particularly along the forward edge thereof. It is believed the significance of the slots will be appreciated when considering FIGS. 3 and 10 in particular which best show the outward turning of the flanges 106 along both the bottom edge and forward edge of each side wall 88 in both contemplated positions of the blower assembly 84. The third and fourth edges of each of the side walls 88, for purposes of rigidity, may be inwardly turned. This will have no effect on the introduction or removal of the blower assembly through the access opening 112.

As will be readily appreciated from the drawings, the blower induced air flow is drawn inward through the blower 84 and subsequently discharged through the outlets 110 which exhaust through an appropriate damper assembly 118 which in turn discharges through conventional external duct work to the exterior.

In order to provide for the desired air flow through the blower or blower assembly 84, it will be appreciated that the blower-mounting side walls 88 are provided with central openings therein aligning with the side intakes of the blower wheels 100.

A cooling flow of air through the motor casing 96 is also desired. As such, the inner face 119 of each blower scroll 90 is provided with an enlarged shaft surrounding opening which provides for a direct communication with the openings 120 in the motor casing end plate 94. Appropriate openings or vents 122 about the body of the casing 96 will provide for introduction of the cooling air. Appropriate sealing means, such as gaskets 124, will be provided between each blower scroll and the corresponding end plate of the motor casing 96 as a means to ensure proper cooling air flow through the motor casing without leakage, and also to reduce vibration and noise by preventing direct metal-to-metal contact therebetween.

Motor cooling air is introduced to the blower compartment 86 through the access opening 112 in the underlying top panel 66 of the main housing 58. A removable shallow tray 126 is mounted to the undersurface of the top panel 66 to underlie the air passing opening 112 and extend forwardly therefrom beyond the front wall of the secondary housing 78 and in underlying relation to a series of upwardly opening air-passing louvers 128. Additional air accommodating openings 130 may be provided in the front upturned flange of the air passage forming tray 126. With the louvers, in particular, so positioned, it will be appreciated that the motor-cooling air will be drawn from a zone of uncontaminated cool air above the oven and quite remote from both the oven compartment and the air flow from the range top itself.

The tray 126 will normally be removably retained, along the vertically projecting rear flange thereof, by a slot 132 within the flange which engages over a projecting tab 134 along the corresponding rear edge of the panel opening 112. The front of the tray is affixed to the overlying panel 66 by a screw 136 engaged between the overlying top panel 66 and a laterally directed lip 138 on the vertical front flange of the tray 126. Appropriate sealing strips or gaskets 140 may be provided as needed between the tray and the overlying top panel 66. The removal nature of the air passage forming tray 126 is desirable in order to allow access to the blower for servicing, repositioning, and the like.

Figure 7:
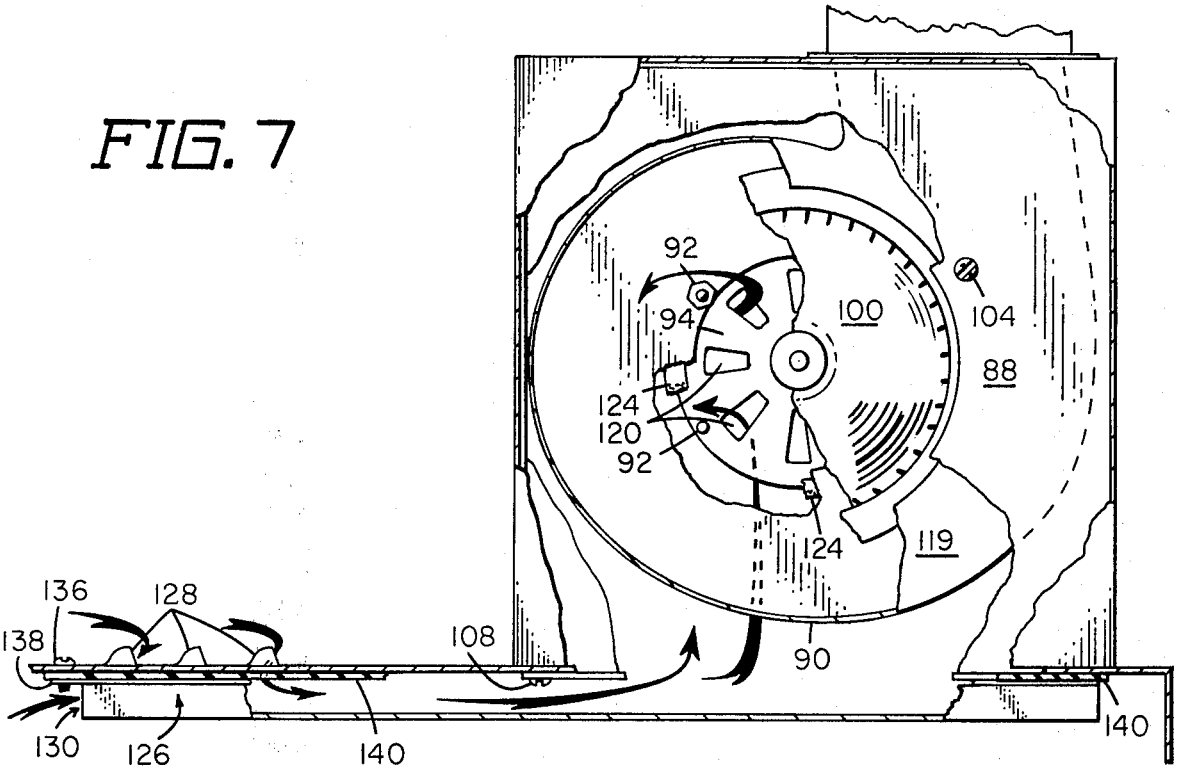
FIG. 7 is a side view of the structure shown in FIG. 6 with portions removed.
Figure 8:
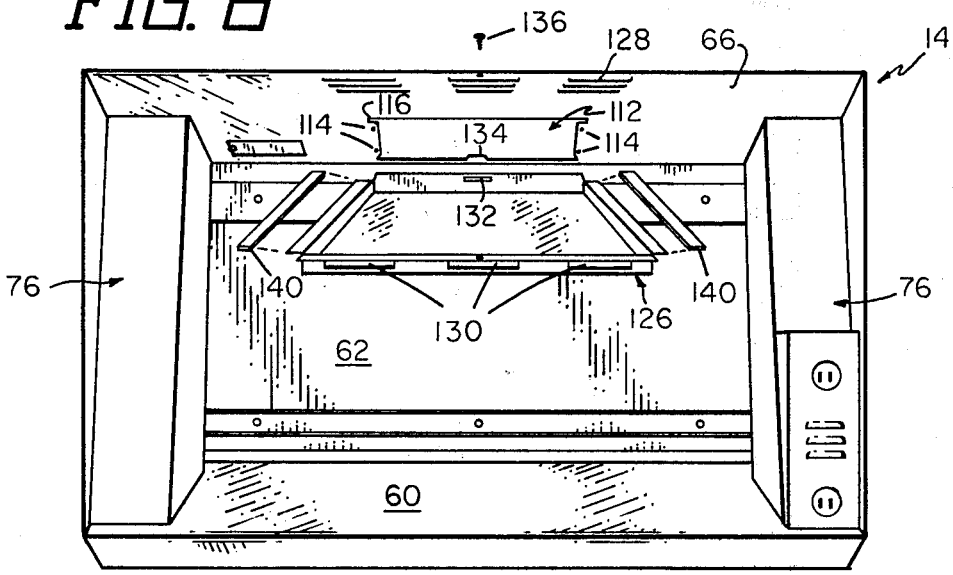
FIG. 8 is a front perspective view of a portion of the appliance shown in FIG. 3 and FIG. 4.
Figure 9:
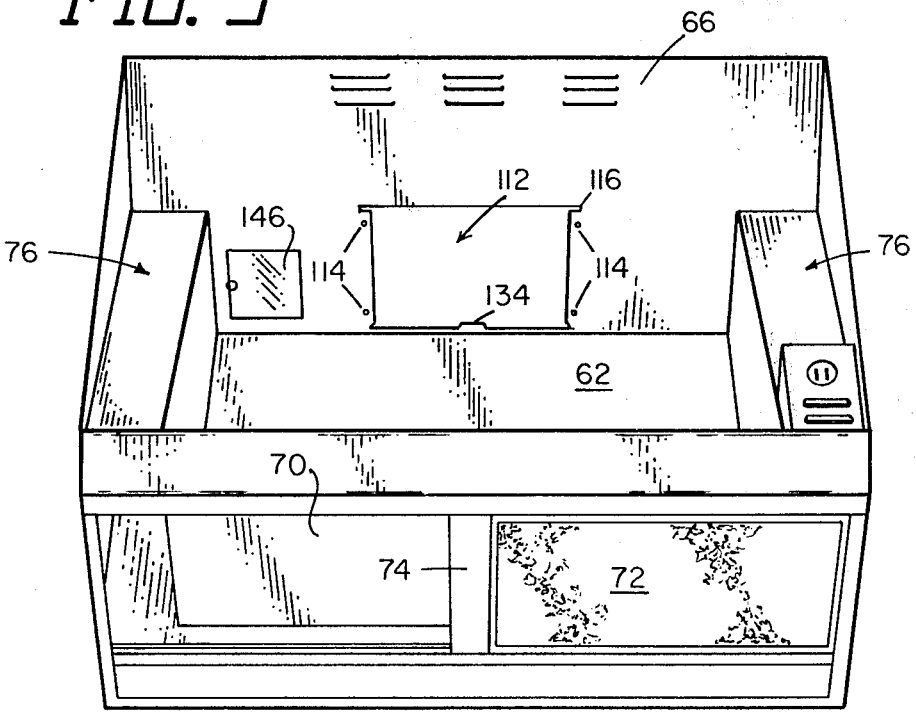
FIG. 9 is a bottom or lower perspective view of the same portion of the appliance shown in FIG. 8.

The manner in which assembly 84 is accessed for rotation to the alternative exhaust position or accessed for the purposes of repair or servicing is best shown in FIGS. 7, 8 and 9 in combination with FIGS. 1 and 3. Access to assembly 84 is gained by disassembly of appliance 10 including removal of panel 24 and microwave oven 12. After removal of microwave oven 12, channel 126 is dropped down as shown in FIG. 8 by removal of screw 136. Dropping down channel 126 exposes screws 108, shown in FIG. 7, which hold assembly 84 in place. Removal of screws 108 from holes 114 allows assembly 84 to drop down through opening 112 for easy rotation to a horizontal exhaust position or for servicing or repair. Note in FIG. 8 that channel 126, when attached to assembly 14 by screw 136, is further held in place by sliding tab 134 into slot 132. Channel 126 is firmly contacted to assembly 14 by the gaskets 140. This provides a good seal against air leakage from the oven compartment into the blower chamber.

By making assembly 84 directly rotatable to adapt to different installations without modification, appliance 10 exhibits the same exhaust ventilation capacity regardless of the manner of installation. This is a distinct advantage in that the same appliance will exhibit the same ventilation capacity in either a vertical or a horizontal exhaust installation. In other words, the capacity will be a function only of the static pressure exhibited by the external ductwork, not the orientation of assembly 84 in appliance 10. This adds flexibility to appliance 10 by allowing its manner of installation to be changed without a corresponding changing of the ventilation capacity. The cubic feet of air moved through the appliance 10 does not change unless the external ductwork changes.

FIGS. 3, 4 and 5 show the air movement along an air flow path through assembly which particularly relates to ventilation of a range top or the like. Hot, grease-laden air rising from an underlying range surface or cooking grille (not shown) is drawn through filters 72 into the overlying cavity 70 which actually constitutes the air intake. FIG. 5 is a side view of that shown in FIG. 4 with side panel 64 removed. The air subsequently moves through channels 76 and into blower scrolls 90 through openings in side walls 88 by motor 98. From blower scrolls 90, the air is exhausted from appliance 10 through damper assembly 118 and appropriate external ductwork not shown but well known in the art.

Figure 6:
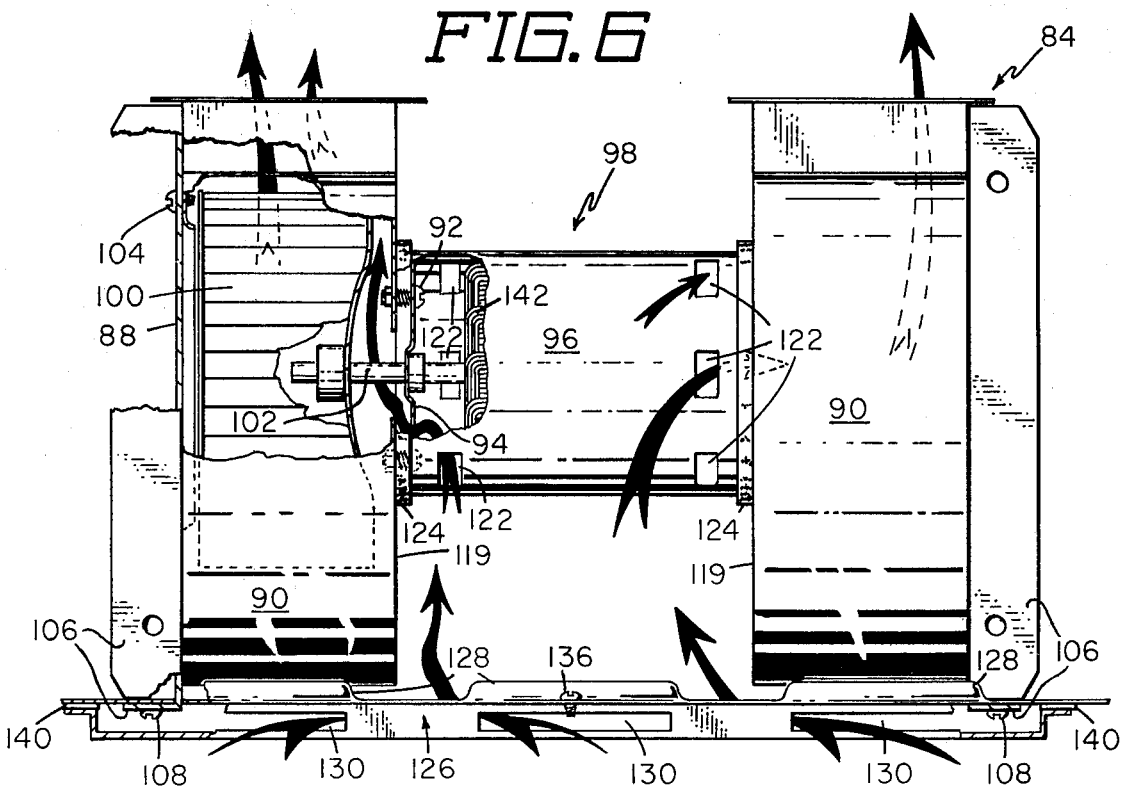
FIG. 6 is a front view of a portion of the appliance shown in FIG. 4 with greater detailing of the related air movement.

Cooling air movement through motor 98 and into blower scrolls 90 is shown in detail in FIG. 6 and FIG. 7 in combination with FIG. 3. The air moving along a separate air path is drawn into assembly 14 through intake louvers 128 and openings 130. The air enters tray or channel 126 and is ducted to the general area of motor 98. The air is drawn through openings 122 in outer case 96 and past windings 142 of motor 98 by the negative pressure created in blower scrolls 90 by blower wheels 100. From the motor, the air is drawn into blower scrolls 90 through openings 120 in motor end plates 94 and exhausted into damper 118 for discharge in the manner already described.

By drawing in air at a relatively high level above the lower cooking surface, motor 98 is cooled with relatively cooler, dryer and cleaner air. As a result, motor windings 142 are kept cooler and cleaner, and motor 98 operates correspondingly more efficiently. Furthermore, the introduction of cool clean air tends to maintain the blower assembly relatively uncontaminated from water, cooking fumes, odors and cooking grease.

Figure 2:
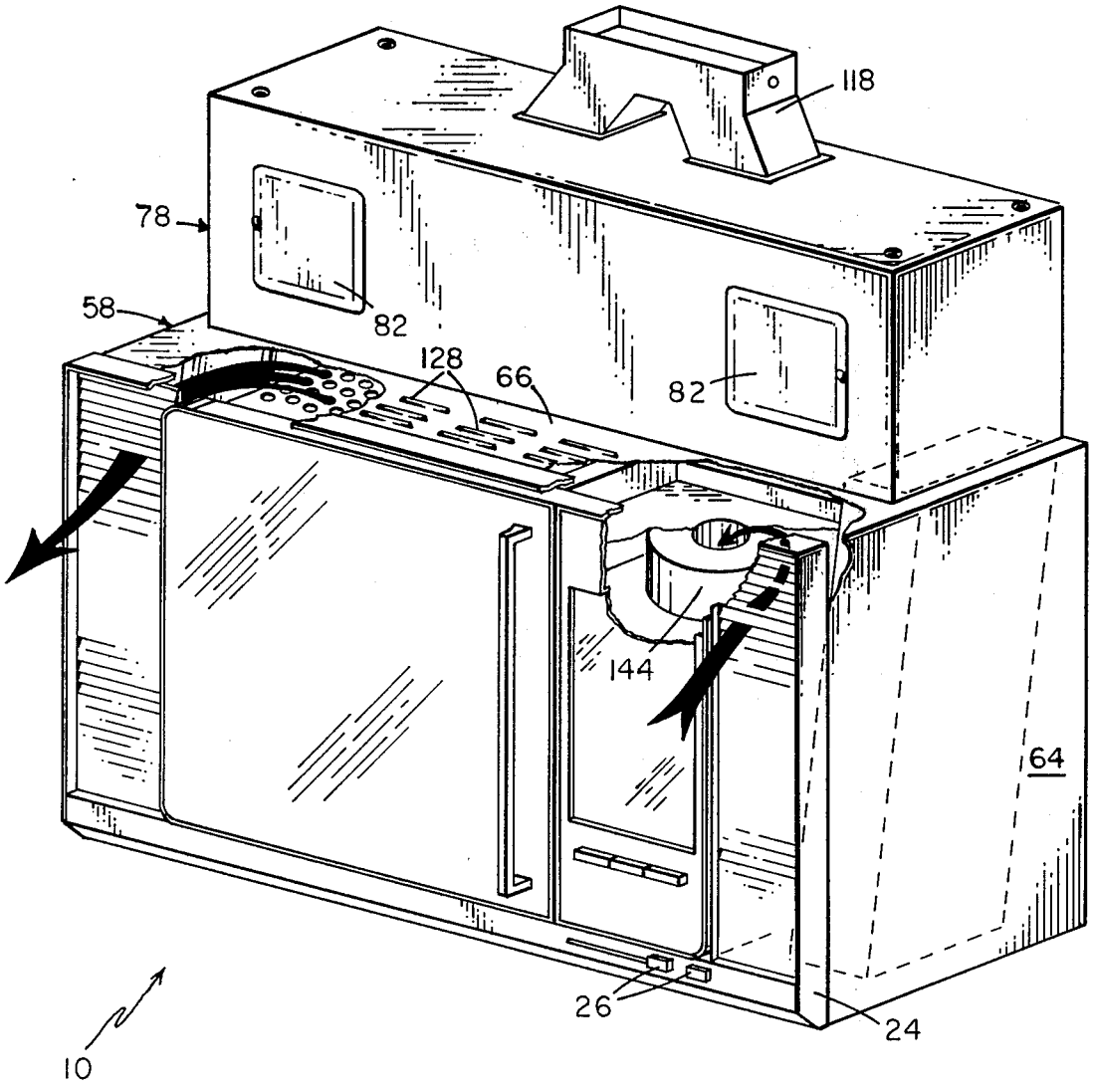
FIG. 2 is a perspective view of the assembled appliance shown in FIG. 1 with portions broken away showing a portion of the air flow.

The air flow through appliance 10 is completed by the separate microwave oven air flow system or air path shown in FIG. 2. Air is drawn in at a relatively high level intake through panel 24 remote from the hot air receiving cavity 70 and into the oven blower scroll 144. From there the air is directed through the high voltage component compartment (not shown) and through the cooling fins of the magnetron (not shown) in any number of ways well known in the art. A portion of the air may be directed through the oven cavity and past an air driven microwave stirrer or antenna (not shown) and exhausted from the oven in any manner well-known in the art. One such representative microwave oven air flow system is shown and described in U.S. Pat. No. 4,284,868 which is hereby incorporated by reference.

As already shown and described, appliance 10 is readily adaptable to a vertical or a horizontal exhaust installation. In addition, the entire system is readily cleanable and serviceable. Furthermore, by its very design, the frequency and the nature of any needs to clean or service the appliance 10 are greatly reduced. The three air flow systems that together make up the air flow system for appliance 10 are such that appliance 10 remains relatively clean. Hot, grease-laden air is drawn into appliance 10 through grease filters 72, and moved along a flow path segregated from sensitive components or the microwave oven compartment. The volatile cooking by-products, not caught by the grease filters 72, are swept up into channels 76 by the negative pressure created by blower wheels 100. The centrifuge action of wheels 100, in forcing the air against the outer walls of the scrolls, tends to cool and pressurize the air and liquefy the water and grease vapor, not caught by filters 60, within the blower housing.

As a result of the distinct air flow systems, the microwave oven 10 is provided with the coolest possible, the dryest possible and cleanest possible air for its sensitive air needs. Furthermore, the exhaust motor 98 is similarly provided with cool, dry and clean air to maximize its efficiency and simultaneously minimize the amount of grease build up in the motor windings.

In a complimentary fashion the structure of the system is designed to minimize grease build-up which occurs. This may best be appreciated in FIGS. 1, 2, 3 and 4. Noting FIG. 1, the oven bulb 32, may be reached through one of the access panels 82 into an overlying chamber provided with a similar access panel 146 in the bottom wall thereof. The same access panels 82 allow easy access to the area of blower scrolls 90 for cleaning purposes. Furthermore, removal of grease filters 72 allows access to channels 76 for cleaning purposes. Hence, the entire appliance 10 is readily accessible in the event of accumulation of a buildup of grease rising off the lower range, cooktop or grille surface.

Although the air flow system for appliance 10 has been described with respect to specific details of certain preferred embodiments, it is not intended or required that such details limit the scope of the invention otherwise set forth in the following claims. It will be apparent that various modifications and changes may be made by those skilled in the art without the parting from the spirit of the invention as expressed in the accompanying claims. Hence, all matters shown and described are intended to be interpreted as illustrative and not in a limiting sense.

We claim:

1. In a combined microwave and ventilator system for installation above a range top or the like, a ventilator assembly including an oven receiving and supporting compartment, a first air path through said ventilator, said first air path including air intake means underlying said oven compartment, vertically extending air passage means positioned laterally of and out of communication with said oven compartment, said air passage means being in air receiving communication with said air intake means, air discharge means remote from said air intake means and said oven compartment, said air passage means communicating with said air discharge means, a power driven exhaust blower assembly adjacent said air discharge means for effecting a flow of air along said first air path with said flow moving into said air intake means, along said air passage means and out said discharge means, a second air path extending through said oven receiving compartment and including an air intake above and remote from said air intake means of the first air path, a third air path for supplying cooling air to said blower assembly, said third air path comprising an air intake above and remote from said air intake of said second air path and said air intake means of said first air path, said third air path communicating with said air discharge means of said first air path whereby both said first air path and said third air path exhaust through a common air discharge means, said ventilator assembly including a main housing having a bottom panel, opposed side panels, and a top panel, a downwardly directed cavity defined immediately beneath and substantially coextensive with said bottom panel, said cavity comprising said air intake means of said first air path, said air passage means of said first air path comprising a pair of vertically elongated closed channels, one extending along each of said side panels, each of said channels having a lower end in direct communication with the cavity underlying said panel, said oven receiving compartment being defined between said channels, means for associating filters with said cavity defining said air intake means, a secondary housing of lesser depth than said main housing, said secondary housing overlying said main housing, said top panel of said main housing constituting the bottom of said secondary housing, said air passage means-defining channels having upper ends opening into said secondary housing, said secondary housing including a chamber receiving said blower assembly, said air discharge means of said first path exiting outward from said secondary housing, said chamber receiving said blower assembly being generally aligned over said oven compartment, said secondary housing including side chambers to each side of said blower assembly chamber and in air flow passing communication therewith, one of said air passage means channels communicating with each side chamber, said third air path comprising an opening defined through said top panel between said blower assembly chamber and said underlying oven compartment, a shallow tray underlying said top panel within said oven compartment, said tray underlying said opening and extending beyond said secondary housing, said air intake of said third air path comprising at least one intake opening into that portion of the tray beyond the secondary housing, said tray having peripheral edge portions sealed to the overlying top panel to preclude communication between said oven compartment and the interior of the tray.

2. The system of claim 1 including means removably mounting said tray for selective access to the blower assembly chamber through the oven compartment.

3. The system of claim 2 including means removably mounting the blower assembly within the blower assembly chamber for selectively repositioning of the blower assembly to optionally discharge vertically or horizontally.

4. The system of claim 3 including selectively openable access panels into the side chambers of the secondary housing.

* * * * *